US005242093A

United States Patent [19]

Worrell et al.

[11] Patent Number: 5,242,093

[45] Date of Patent: Sep. 7, 1993

[54] ICED TEA PITCHER HAVING A PIVOTED LID ASSEMBLY

[75] Inventors: Robert Worrell, Hopkins, Minn.; William E. Midden, Springfield, Minn.

[73] Assignee: Bunn-O-Matic Corporation, Springfield, Ill.

[21] Appl. No.: 776,572

[22] Filed: Oct. 15, 1991

[51] Int. Cl.[5] ..... A47G 19/00; B65D 83/00

[52] U.S. Cl. ..... 222/470; 222/510; 222/556

[58] Field of Search ..... 222/470, 472, 475.1, 222/465.1, 567, 568, 473, 474, 505, 510, 556

[56] References Cited

U.S. PATENT DOCUMENTS

| | | | |
|---|---|---|---|
| 2,187,927 | 1/1940 | Ayotte | 222/470 |
| 2,272,867 | 2/1942 | Cobel | 222/473 |
| 3,168,226 | 2/1965 | Underwood et al. | 222/568 X |
| 3,400,865 | 9/1968 | Hester | 222/568 X |
| 3,847,311 | 11/1974 | Flores et al. | 222/473 |
| 4,141,473 | 2/1979 | Hudson | 222/474 X |
| 4,344,549 | 8/1982 | Paradis et al. | 222/475.1 |

FOREIGN PATENT DOCUMENTS

| | | | |
|---|---|---|---|
| 2131209 | 1/1973 | Fed. Rep. of Germany | 222/473 |
| 2612157 | 9/1988 | France | 222/474 |

*Primary Examiner*—Andres Kashnikow
*Assistant Examiner*—Anthoula Pomrening
*Attorney, Agent, or Firm*—Trexler, Bushnell, Giangiorgi & Blackstone, Ltd.

[57] ABSTRACT

A pitcher for holding and serving liquids including a jar portion, a ring member engageable with the jar portion, and a cover assembly engageably with the ring member. A rim portion of the cover assembly is defined by an aperture formed through the cover assembly and an integral spout is formed in a section of the rim portion for controllably pouring liquids from the pitcher. A mouth is formed at one end of the jar and a necked portion is formed on a surface of the jar spaced apart from the mouth. A diameter of the necked portion is smaller than a diameter of the mouth and includes a concave portion which is sized and dimensioned for matably engaging the ring member. Thread portions formed on cooperative surfaces of the cover assembly and the ring member attach the cover assembly to the jar. Included in the cover assembly is a cap for covering the aperture in the cover assembly and a lid assembly carried on the cap and movable relative to the cap and the spout formed on the rim portion. The lid assembly is a unitary body formed with an elongated beam member having a movable lid at one end and a thumb lever at the other end. Application of a force on the thumb lever selectively displaces the lid from the spout.

7 Claims, 6 Drawing Sheets

ICED TEA PITCHER HAVING A PIVOTED LID ASSEMBLY

BACKGROUND OF THE INVENTION

This invention relates to containers for storing and serving liquids. It is desirable to have a top portion of such a container which is easy to assemble and removably attachable to a jar portion for purposes of cleaning and repair.

Typically, consumers prefer a transparent container to permit easy identification of the contents. However, from a production standpoint, it is costly to produce molded pitchers including an attached spout and handle portion. It is also desirable to provide a pitcher which has a top to protect the contents of the pitcher. As an additional convenience it is desirable to provide a cover which has a displaceable lid so that a user does not have to remove the cover every time they dispense a quantity of liquid from the container.

One way to provide a transparent pitcher with a cover and a movable lid is to produce a jar portion from glass or another transparent material and to produce a cover assembly of plastic or other suitable material. The cover assembly is then attached to the jar portion to form the assembled pitcher. Prior art pitchers have used cover assemblies which attach to the jar portion by way of threads formed on the jar portion and cooperative threads on a corresponding surface of the cover portion. However, a problem arises in that it is difficult and costly to produce threads in a glass jar portion.

Another problem with prior art containers is that the cover portion may tend to disengage or "unscrew" from the threads formed in the jar portion with continued use of the pitcher.

Yet another problem with prior art pitchers is that the assemblies used to provide a movable lid are often relatively complex, using several independent moving components. It would be desirable to reduce the number of components for assembly purposes as well as to reduce potential wear damage and provide repair advantages.

OBJECTS AND SUMMARY OF THE INVENTION

A general object of the present invention is to provide a pitcher having a jar portion which does not have threads formed thereon and a cover assembly which attaches to the jar portion without threads between the jar and the cover assembly.

Another object of the present invention is to provide a cover assembly which will not disengage from the jar portion upon regular use.

Still another object of the present invention is to provide a pitcher having a jar portion and an attachable cover portion which includes a cap covering the jar portion and a movable lid covering a spout formed in the cover assembly.

Yet another object of the present invention is to provide a single piece unitary lid assembly which includes the lid covering the spout and a thumb lever positioned near a handle formed integral with the cover assembly.

Briefly, and in accordance with the foregoing, the present invention comprises a pitcher for holding and serving liquids. The container includes a jar portion, a ring member engageable with the jar portion, and a cover assembly engagable with the ring member. A rim portion of the cover assembly is defined by an aperture formed through the cover assembly and an integral spout is formed in a section of the rim portion for controllably pouring liquids from the pitcher. A mouth is formed at one end of the jar and a necked portion is formed on a surface of the jar spaced apart from the mouth. A diameter of the necked portion is smaller than a diameter of the mouth and includes a concave portion which is sized and dimensioned for matably engaging the ring member. Thread portions formed on cooperative surfaces of the cover assembly and the ring member attach the cover assembly to the jar. Included in the cover assembly is a cap for covering the aperture in the cover assembly and a lid assembly carried on the cap and movable relative to the cap and the spout formed on the rim portion. The lid assembly is a unitary body formed with an elongated beam member having a movable lid at one end and a thumb lever at the other end. Application of a force on the thumb lever selectively displaces the lid from the spout.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which.

DETAILED DESCRIPTION OF THE PREFERRED EMBODIMENT

Figure 1:
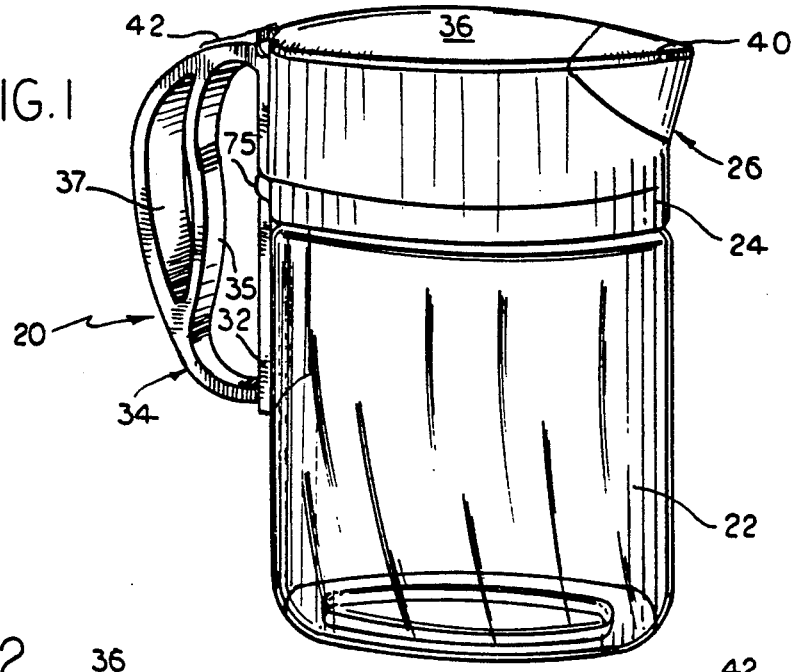
FIG. 1 is a prospective view of a pitcher of the present invention.

While the invention may be susceptible to embodiment in different forms, there is shown in the drawings, and herein will be described in detail, a specific embodiment with the understanding that the present disclosure is to be considered an exemplification of the principles of the invention and is not intended to limit the invention to that as illustrated and described herein.

Figure 2:
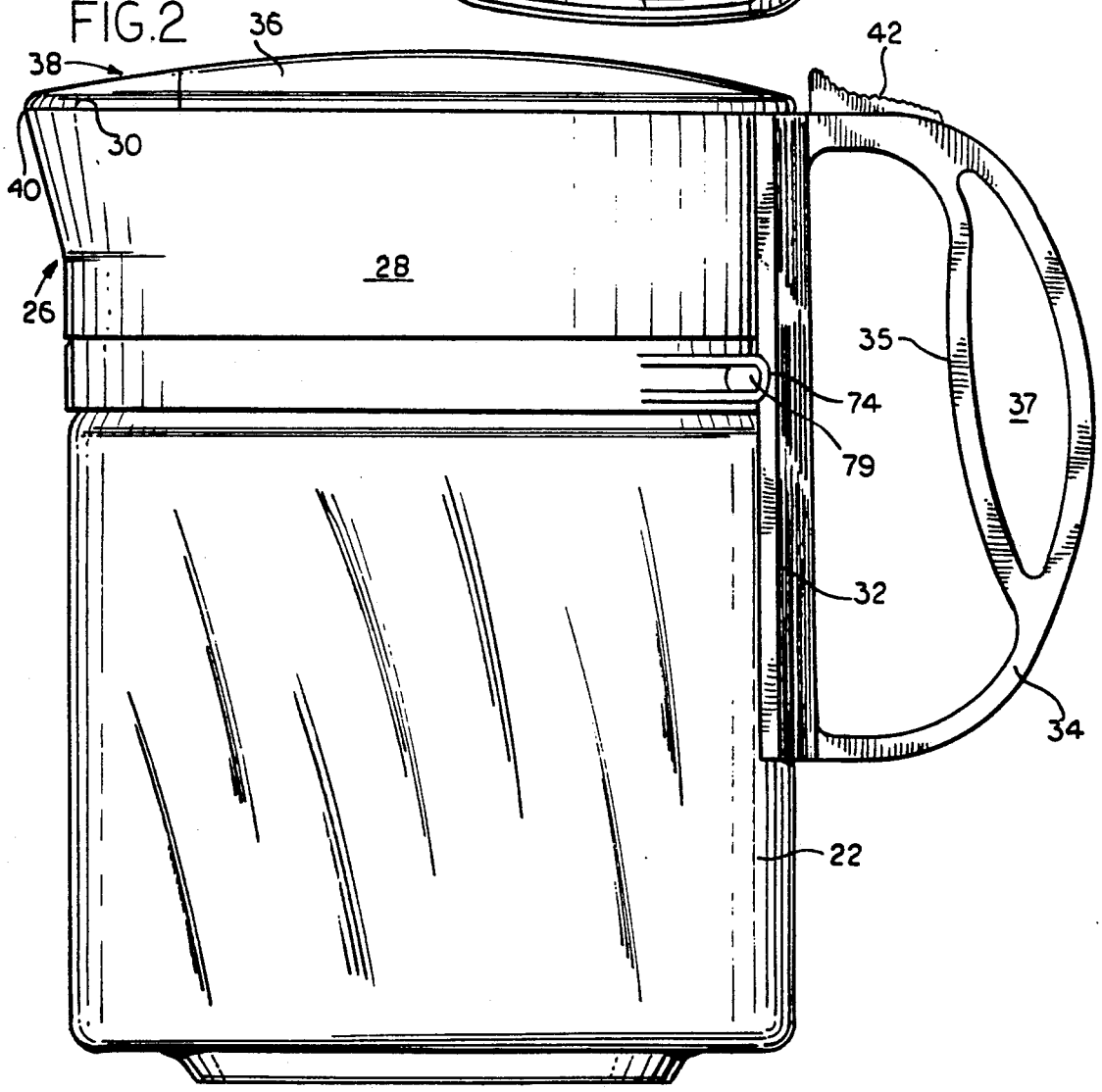
FIG. 2 is a side elevation of the pitcher.
Figure 4:
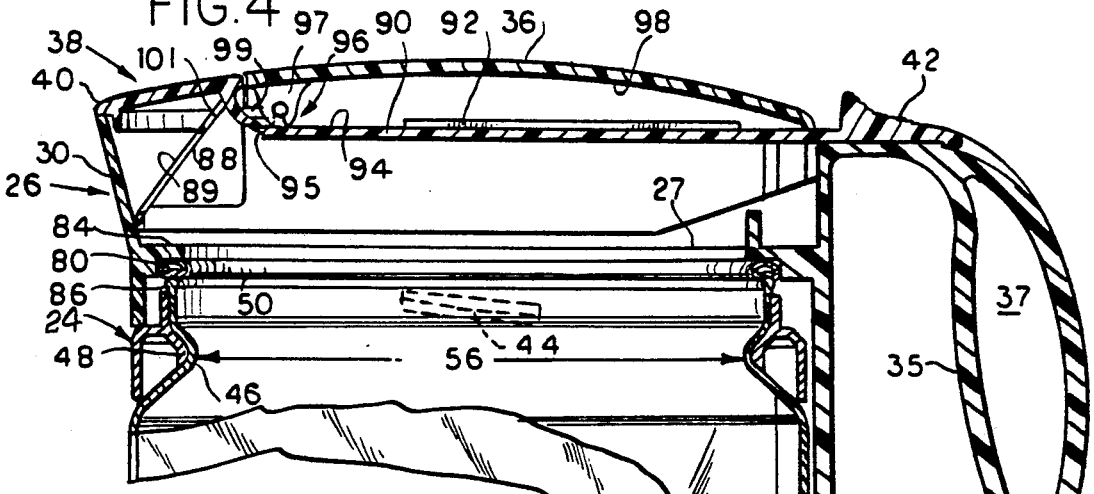
FIG. 4 is a partial fragmentary cross-sectional view of the pitcher as taken along lines 4—4 as shown in FIG. 3.

Referring now to the drawings, wherein like parts are designated by the same reference numerals throughout the figures, a pitcher 20 is shown in FIG. 1. The pitcher 20 includes a jar portion 22, a ring member 24, and a cover assembly 26. As shown in FIGS. 1, 2, AND 4 the ring member 24 is positioned between the jar portion 22 and the cover assembly 26. An aperture 27 through the cover assembly defines a rim portion 28 of the cover assembly 26. A spout 30 is integrally formed in the rim 28 on the front of the pitcher 20. Extending generally perpendicularly downwardly from the rim is a brace member 32 to which an integrally formed handle 34 is attached. A reverse curve portion 35 is formed in the loop of the handle 34 to provide a better grip on the handle 34. The reverse curve portion 35 defines a space 37 and essentially provides a thickness dimension to the handle 34 to make gripping more comfortable and more stable. A cap 36 nestably inserts into the rim portion 28 of the cover assembly 26. Carried on the inside of the cap 36 is a lid assembly, which will be described in greater detail hereinbelow, including a lid 40 and a thumb lever 42 therein.

Figure 3:
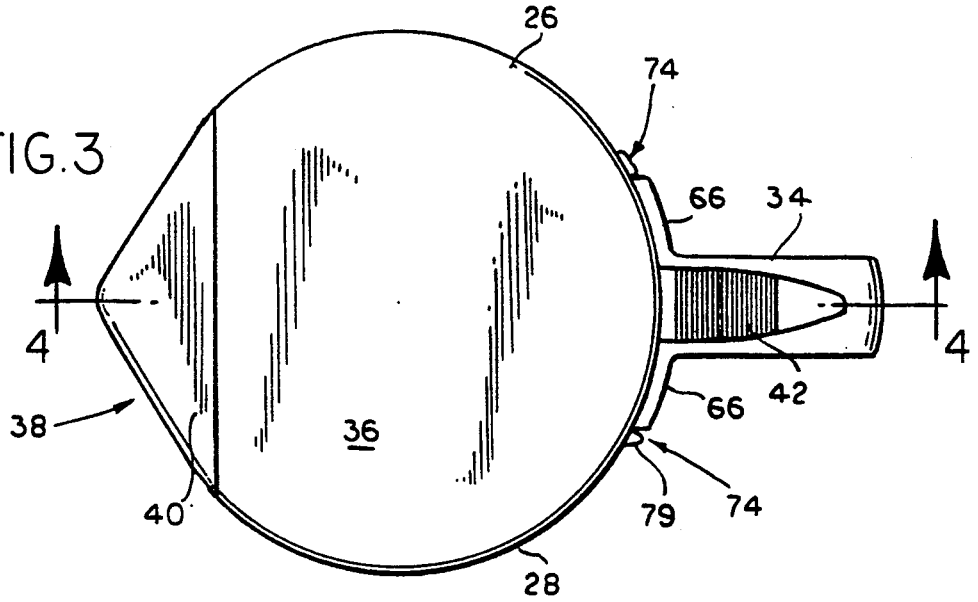
FIG. 3 is a plan view of the pitcher.

FIG. 3 provides a plan view of the cover assembly 26 showing the cap 36 positioned on the rim portion 28. The lid structure 40 is generally located opposite the thumb lever 42 on the cap 36. Details of the lid assembly 38 will be discussed in greater detail hereinbelow.

A partial fragmentary cross-sectional view of the pitcher 20 taken along line 4—4 in FIG. 3 is shown in FIG. 4. The cross-sectional view shows the cover assembly 26 attachment to the ring member 24 by cover engaging means 44 (shown in phantom line in FIG. 4 and discussed in greater detail hereinbelow). The ring member 24 is engaged around the perimeter of the jar portion 22 between the cover assembly 26 and the jar portion 22. Generally, a first portion 46 of the jar 22 and a potion 48 of the ring 24 cooperatively mate. As shown in FIG. 4 and in the enlarged view as illustrated in FIG. 5, the first portion 46 of the jar 22 is a necked portion and the portion 48 of the ring 24 is a generally convex, annular surface which fits into the necked portion 46 of the jar 22.

Figure 5:
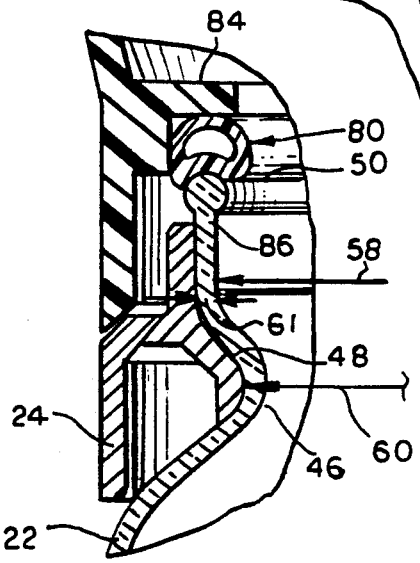
FIG. 5 is an enlarged detail view of a portion of the cross-section as shown in FIG. 4 illustrating the relationship between a ring member, a cover assembly, a jar lip and a gasket.

With reference to both FIGS. 4 and 5, the jar portion 22 has a mouth 50 which is generally coincident with the aperture 27 formed through the cover assembly 26. The mouth 50 has a first diameter 54 and the first portion 46 of the jar 22 has a second diameter 56. The ring member 24 has at least a maximum ring diameter 58 and a minimum ring diameter 60. As illustrated, the maximum ring diameter 58 is generally equal to the first diameter 54 of the mouth 50 and the minimum ring diameter 60 is generally equal to the second diameter 56 of the first portion 46 of the jar 22.

An alternative embodiment comprises a minimum ring diameter 60 which is slightly larger (the thickness 61 of the jar 22 wall) than the first diameter 54 and a maximum ring diameter 58 which is slightly larger (the thickness 61 of the jar 22 wall) than the second diameter 56. In the alternative embodiment, the first portion 46 of the jar 22 would result in a convex surface instead of a concave surface as is shown in FIGS. 4 and 5. Essentially, the ring member 24 engages the convex surface of the first portion 46 from below and is secured in engagement therewith by the cover assembly 26 in the manner described hereinbelow.

Figure 9:
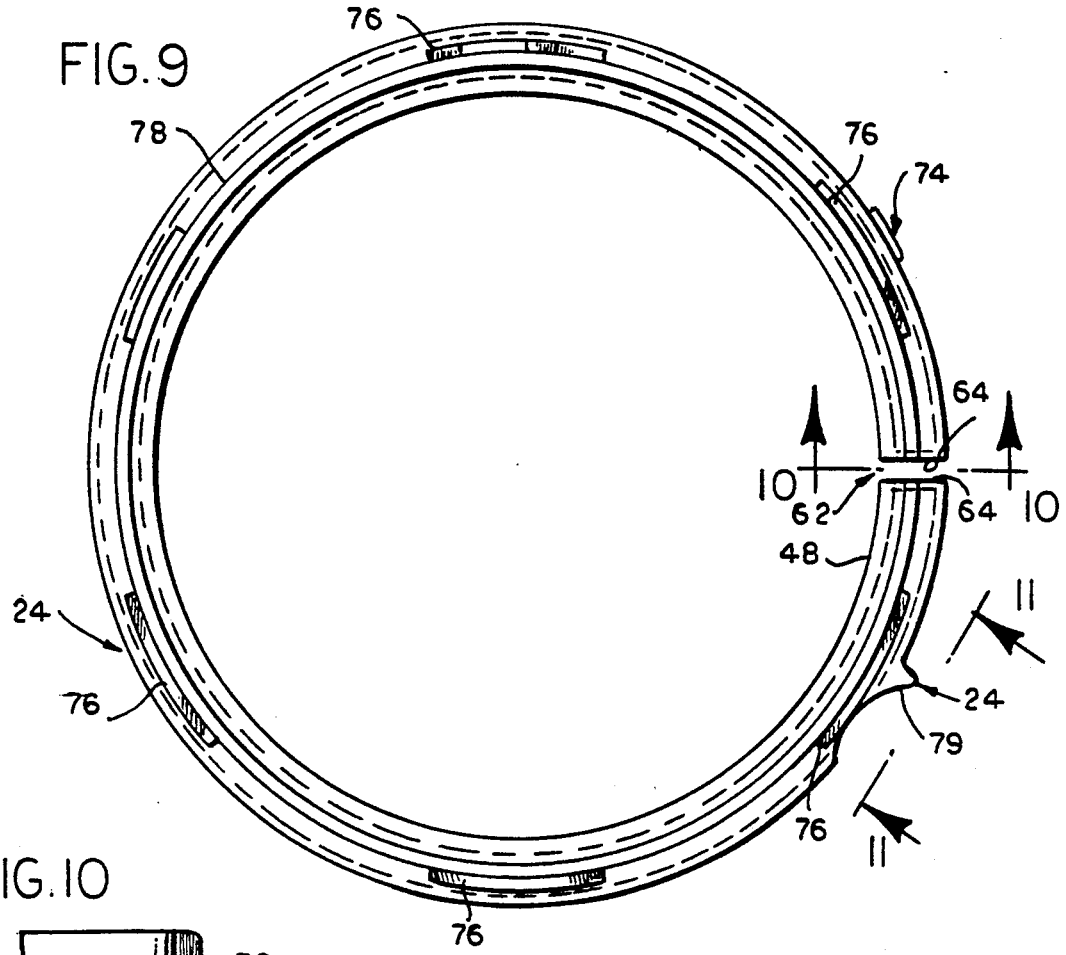
FIG. 9 is a plan view of the ring member.
Figure 10:
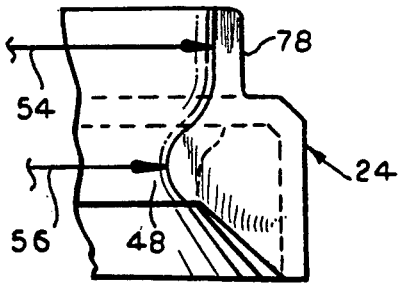
FIG. 10 is an enlarged partial fragmentary side view of the ring as viewed from a gap in the ring taken along line 10—10 as shown in FIG. 9.
Figure 11:
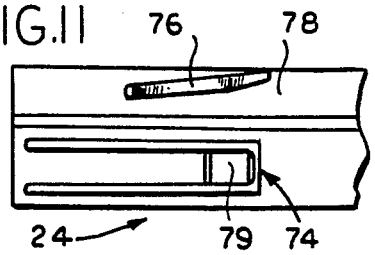
FIG. 11 is a partial fragmentary side view of the ring taken along line 11—11 as shown in FIG. 9 showing a locking protrusion formed on the side of the ring member.

FIG. 9 shows a gap 62 which severs the ring member 24 in one location. The ring member 24 is formed of a suitably rigid yet resiliently flexible material such that the gap 62 permits the ring member 24 to be opened to an diameter which is large enough to engage the ring member 24 with the necked portion 46 of the jar 22. Once the ring member 24 is positioned over the necked portion 46 natural resilient forces of the material used in the ring member 24 tend to bring ends 64 of the gap 62 towards each other.

Figure 6:
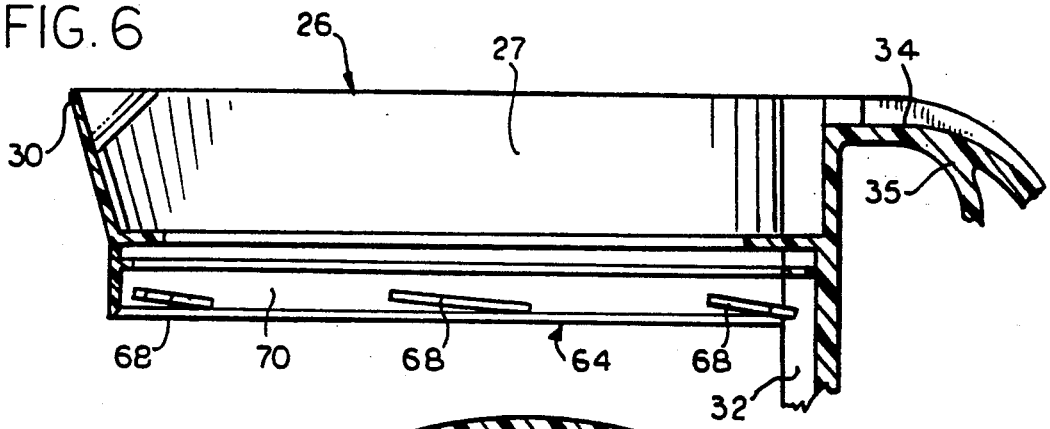
FIG. 6 is a partial cross-sectional view taken through a rim portion of the cover assembly.
Figure 7:
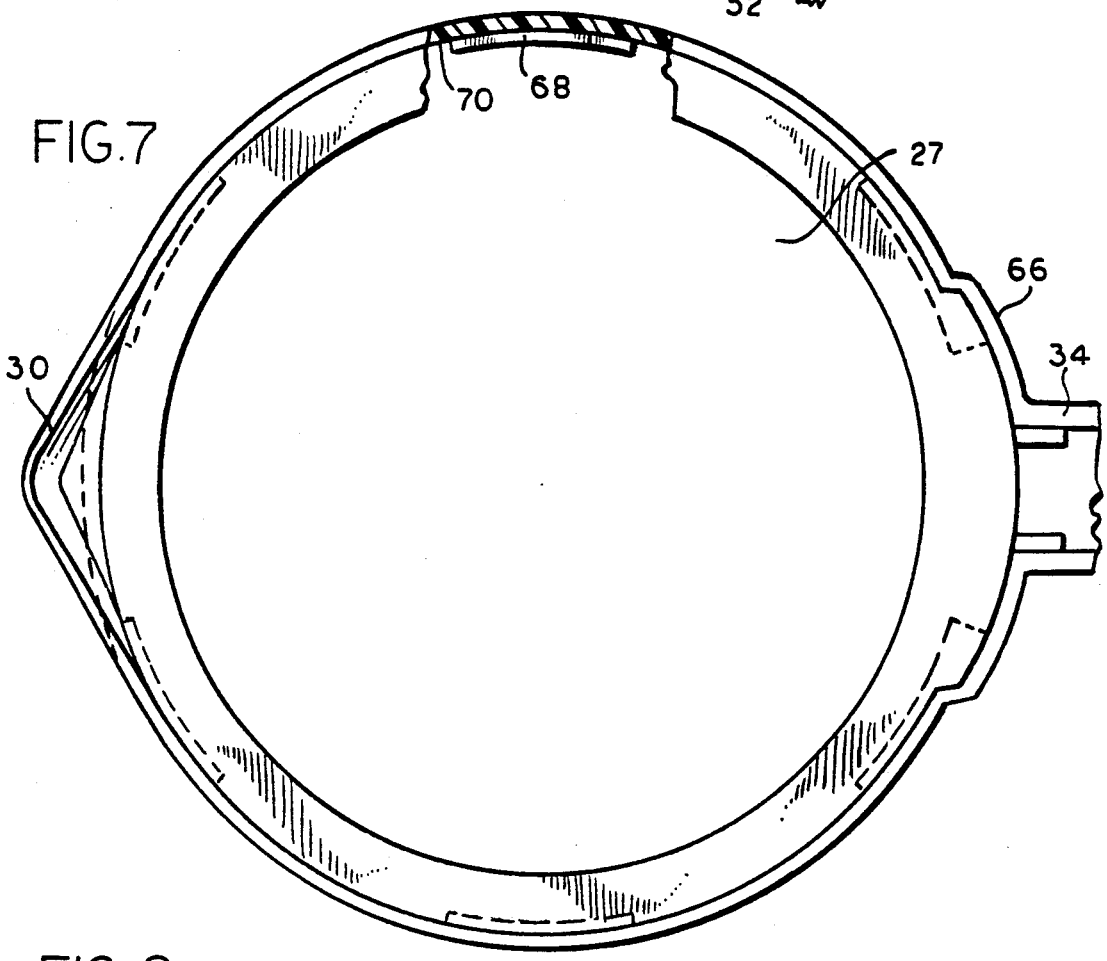
FIG. 7 is a partial fragmentary plan view of the rim portion as illustrated in FIG. 6.
Figure 8:
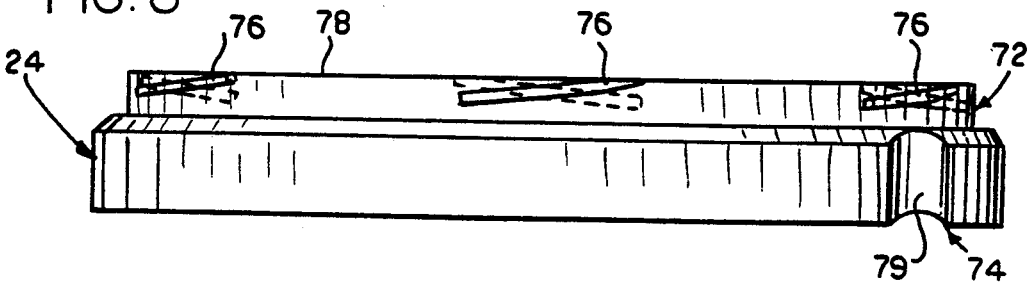
FIG. 8 is a side elevation of the ring member.

With reference to FIGS. 4, 5 and 6, the rim portion 28 of the cover assembly 26 is formed with ring engaging means 64 which include an extending brace member 66, extending generally perpendicularly downwardly from the rim portion 28 and ring engaging thread portions 68 formed on an inside surface 70 of the rim portion 28. The ring member 24 is formed with cover engaging means 44 which include locking means 74 and cover engaging thread portions 76 formed on an outside surface 78 thereof. The cover engaging thread portions 76 are outwardly disposed when the ring member 24 is positioned in the necked portion 46. The ring engaging thread portions 68 on the inside surface 70 of the rim portion 28 are threadedly engaged with the cover engaging thread portions 76 when positioned thereover and rotatably engaged therewith.

Engagement of the ring engaging thread portions 68 and the cover engaging thread portions 76 slightly circumferentially compress the ring member 24 thereby bringing the ends 64 of the gap 62 closer together and more securely engaging the ring member 24 in the necked portion 46 of the jar 22. In the alternative embodiment mentioned above, engagement of the cover assembly 26 with the ring member 24 securely engages the ring member 26 underneath the convex first portion 46 of the jar portion 22.

As the thread portions 68,76 are engaged by rotating the cover assembly 26 about the ring member 24, the brace member 66 attached to the cover assembly 26 is rotated into engagement between the locking means 74 on the ring member 24 (see FIG. 3). The locking means 74 include outwardly extending protrusions between which the brace member 66 is retained. As illustrated in FIGS. 1, 3, 8, 9, and 11 one of the locking means 74 is formed with a recess grip 79 which accommodates a thumb to help rotate the cover assembly 26 and the ring member 24 into engagement. Engagement of the brace member 66 between the locking means 74 prevents rotation of the cover assembly 26 about the ring portion 24 during use thus preventing unintended disengagement of the cover assembly 26 from the jar portion 22.

When the cover assembly 26 is engaged with the ring member 24, a gasket member 80 is compressed between the cover assembly 26 and the jar portion 22 to form a seal therebetween. As shown in FIG. 5, the gasket member 80 is retained against a flange 84 on the cover assembly 26. The gasket member 80 is compressed between the cover portion flange 84 and a lip portion 86 of the jar portion 22. Compression of the gasket 80 forms a seal to prevent liquid in the jar portion 22 from seeping therebetween when being poured from the pitcher 20.

Liquids may be poured from the pitcher 20 by holding the handle 34 and tipping the pitcher towards the spout 30. The spout 30 is integrally formed in the cover assembly 26 generally opposite the handle 34. The cap 36 is nested inside of the aperture 52 of the cover assembly 26 and carries the lid assembly 38. Strainer slits 88 formed though a truncated face portion 89 of the cap 36 form a strainer along the face 89 which is removably covered by the lid 40. The slits 88 are generally vertically oriented and slope backwards towards the handle 32. The slits 88 provide a straining function to retain material such as ice and fruit pieces inside of the container while pouring. Movement of the thumb lever 42 positioned on top of the handle 34 controls the operation of the lid structure 40 covering the spout 30.

Figure 12:
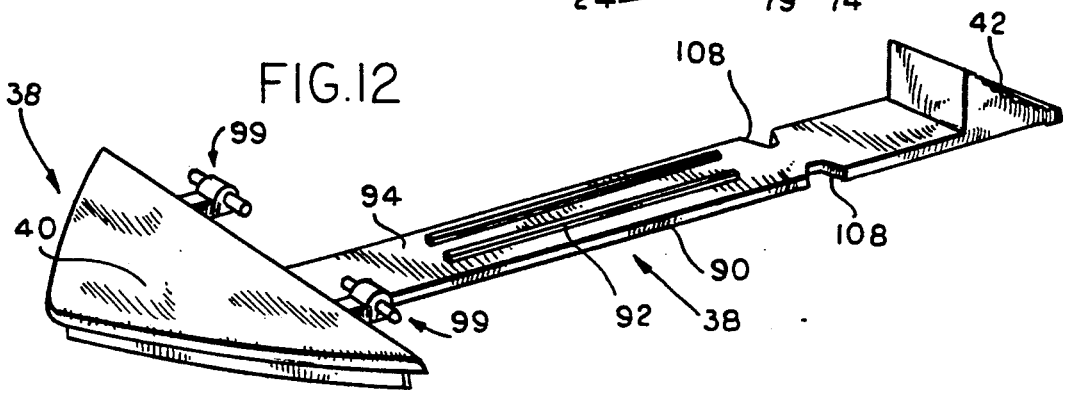
FIG. 12 is a perspective view of a unitary single piece lid assembly which is carried on the inside of a cap.

With reference to FIGS. 12–18, the lid assembly 38 includes the triangular shaped lid 40, the thumb lever 42 and a beam member 90 extending therebetween. As shown in FIG. 12, the lid assembly 38 is a unitary single piece body. Reinforcing ribs 92 are provided on a top and bottom surface 94 of the beam member 90 to provide additional structural strength. A flexible joint 95 is formed in the beam member 90 near the attachment point of the beam member 90 to the lid structure 40 to facilitate movement of the lid structure 40 about a hinge assembly 96.

The hinge assembly 96 includes a first hinge portion 97, formed on an inside surface 98 of the cap 36, which engages a second hinge portion 99, formed on an abutting surface of the lid structure 40, to movably attach the lid assembly 38 to the cap 36. A central aperture 101 and side apertures 103 are formed through the truncated face portion 89. When assembling the lid 40 to the cap 36, the beam member 90 is inserted through the central aperture 101 and the second hinge portions 99 are inserted through respective side apertures 103.

Figure 19:
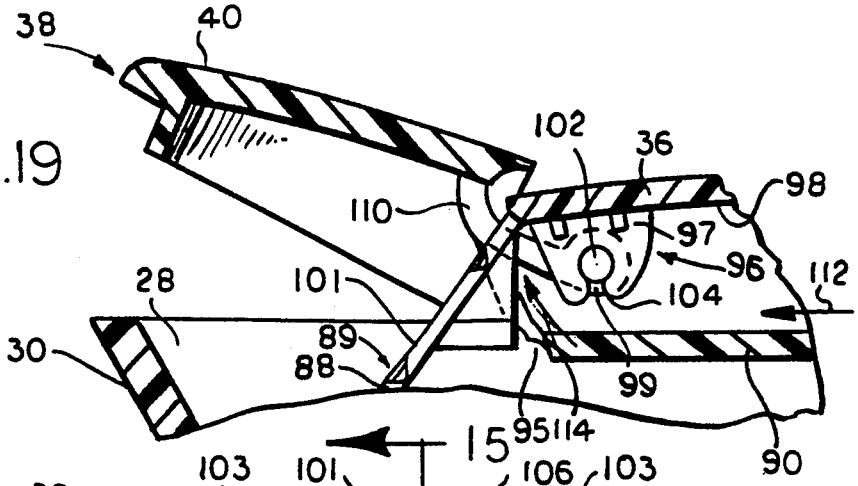
FIG. 19 is an enlarged partial cross-sectional view of the lid as shown in FIG. 18 in which the lid has been raised by a force applied to the beam member attached thereto.
Figure 13:
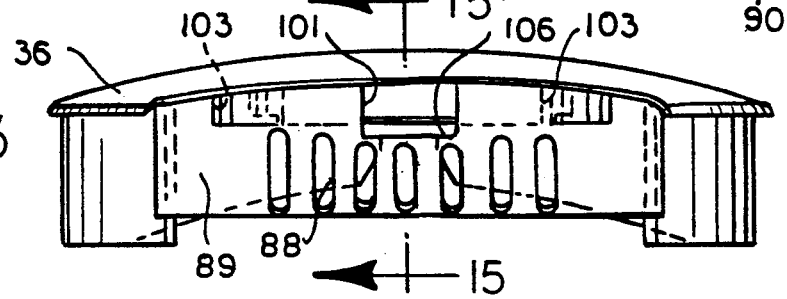
FIG. 13 shows a front elevation of the cap which is insertable into the rim portion of the cover assembly.
Figure 14:
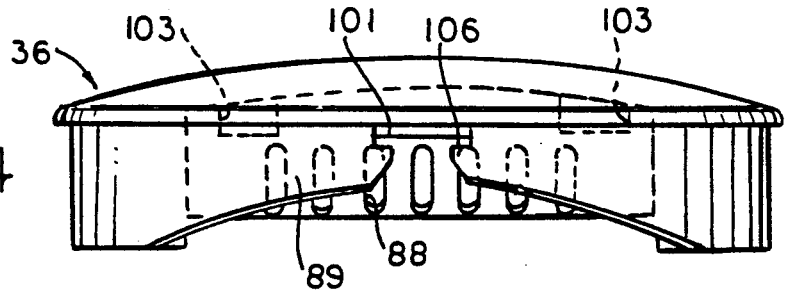
FIG. 14 shows a rear elevation of the cap.
Figure 15:
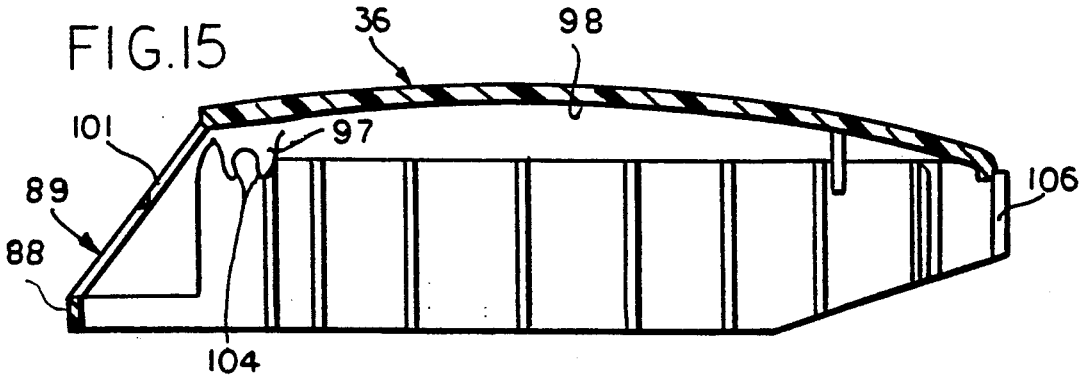
FIG. 15 is a cross-sectional side view of the cap taken along line 15—15 as shown in FIG. 13.
Figure 18:
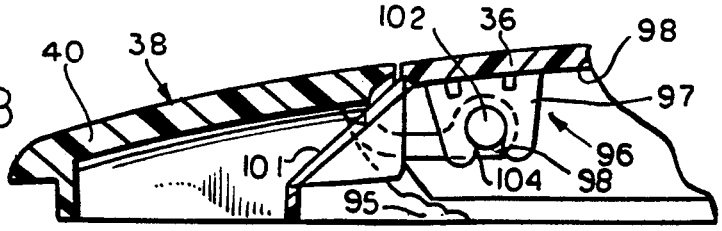
FIG. 18 is an enlarged partial cross-sectional view of a lid of the lid assembly attached to the cap taken along line 18—18 as shown in FIG. 16.

As illustrated in FIGS. 18 and 19, the second hinge portion 99 includes an axle 102 which provides a fixed point of rotation about which the lid structure 40 rotates upwardly away from the spout 30. The axle 102 is fixed by a snap-fit engagement in a receptacle portion 104 in the first hinge portion 97. The lid assembly 38 is retained at a second location on the cap 36 at the thumb lever end 42 by engagement of the beam member 90 in a notch 106 formed through the cap 36. The notch 106 is formed opposite the spout opening 88. Notch entry cuts 108 are formed in the edges of the beam member 90 to permit ease of assembly with the notch 106.

Figure 16:
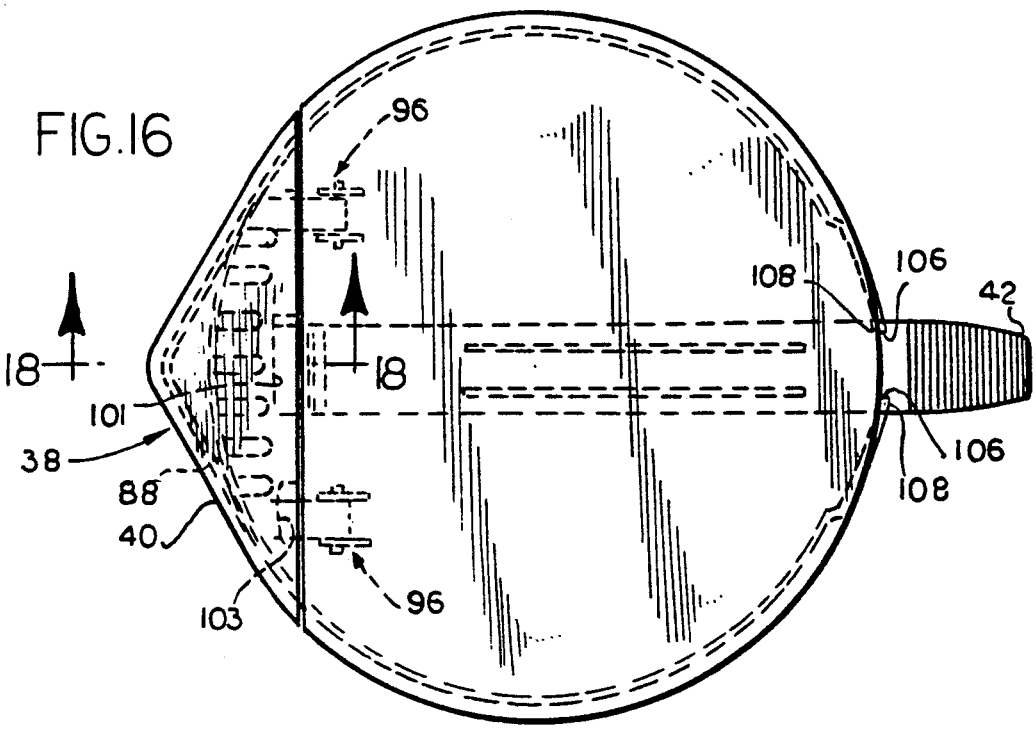
FIG. 16 is a top plan view of the cap with the lid assembly attached thereto.
Figure 17:
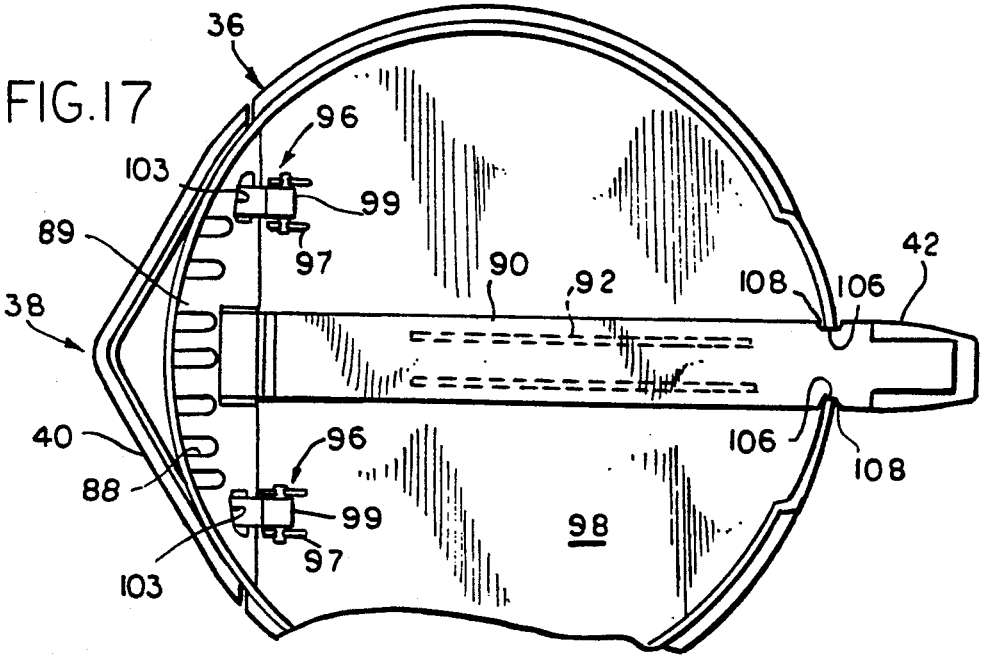
FIG. 17 is a partial fragmentary bottom view of the cap with the lid assembly attached thereto.

When the lid structure 40 is to be opened away from the spout 30, a force 112 is applied to the thumb lever to transfer the force along the beam member 90. The force 112 causes a rotation 114 of the lid structure 40 at the hinge assembly 96. Flexion of the beam member 90 is facilitated by the flexible joint 95 during rotation. Once the lid structure 40 is removed from the spout 30, liquids may be poured therethrough. Positioning of the thumb lever 42 on the handle 34 provides comfortable and easy operation when holding the pitcher 20 by the handle 34 in order to pour liquids therefrom. FIGS. 16 and 17 show a top plan view and a bottom plan view, respectively, of the lid assembly 38 mounted in the cap 36. As shown in FIGS. 16 and 17, a pair of hinge assemblies 96 are employed on either side of the beam member 90 to provide controlled movement of the lid structure 40 away from the cap 36.

In use, the pitcher 20 is assembled by positioning the ring member 24 into the necked portion 46 of the jar 22. The cover assembly 26 is attached to the ring portion 24 by threadedly engaging the ring engaging thread portions 68 on the inside surface 70 of the cover assembly 26 with the cover engaging thread portions 76 formed on the outside surface 78 of the ring member 24. Engagement of the thread portions 68,76 tightens the engagement of the ring member 24 in the necked portion 46. Upon completely engaging the thread portions 68,76, the brace member 32 is engaged between the locking means 74 and the ring member 24. Engagement of the extending member 32 between the locking means 74 prevents unintentional disengagement of the cover assembly 26 from the ring member 24.

The lid assembly 38 is carried in the cap 36 and positioned over the cover assembly aperture 27 to prevent entry of contaminants and potential loss of liquids from the pitcher 20. The lid assembly 38 is assembled with the cap 36 by positioning the notched entry cuts 108 formed on the beam member 90 over the notch 106 formed in the cap 36. Once the beam member 90 is positioned in the notch 106 it is snapped in place. The lid structure 40 is advanced forwardly to a position where the second hinge portion 99 is engaged with the first hinge portion 97. Thus attached, the lid structure may be rotated 114 about an axis of rotation 102 at the hinge assembly 96 by applying a force 112 to the thumb lever 42. The cap 36 and the attached lid assembly 38 are thus positioned in the aperture 27.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

We claim:

1. A pitcher for holding and serving liquids, said pitcher comprising a jar, a ring member, and a closeable cover assembly, said ring member being engageable with aid jar and said cover assembly being releasably engageable with said ring member; a first portion of said jar cooperatively mating with said ring member, said cover assembly retainably engaging said first portion with said ring member when said cover assembly is attached to said ring member; a rim portion of said cover assembly, as section of said rim portion forming a spout for controllably pouring liquids from said jar through said cover assembly; and an aperture formed through said cover assembly, a cap covering said aperture, and a lid assembly carried on said cap; said lid assembly comprising a generally elongated beam member having a movable lid at one end and a thumb lever at the other end, said lid being sized and dimensioned for covering said spout formed in said rim portion and being selectively displaceable therefrom upon application of a transverse force to said thumb lever towards said lid;

said lid and said beam member of said lid assembly being integrally formed as a unitary single piece body, a flexible joint between said lid and said beam member facilitating relative movement between said lid and said beam member; a hinge assembly between said lid and said cap, a force applied along said hinge assembly away from said spout with said lid flexing relative to said beam member at said flexible joint therebetween.

2. A pitcher according to claim 1 wherein said hinge assembly comprises first and second hinge portions on cooperative surfaces of said cap and said lid, said first hinge portion engaged with said second hinge portion providing rotation of said lid about a fixed point relative to said cap; and a notch formed in a side of said cap generally spaced apart from said first and second hinge portions for receiving and retaining said beam member therein, said lid assembly being carried on said cap by attachment at said first and second hinge portions and positioning said beam member in said notch.

3. A pitcher according to claim 1 wherein said ring member and said cover assembly further include rotary locking means on said ring member and said cover assembly for preventing unintentional disengagement of said ring member and said cover assembly.

4. A pitcher for holding and serving liquids, said pitcher comprising a cover assembly, a jar, and a ring member; said ring member being retained on said jar and said cover assembly attaching to said ring member; said cover assembly including a rim portion defined by an aperture formed through said cover assembly, a spout integrally formed in a section of said rim portion, a cap covering said aperture and a lid assembly carried on said cap and movable relative to said cap and said spout; said lid assembly comprising a generally elongated beam member, a movable lid at one end of said elongated beam member and a thumb lever at the other end thereof, said lid being sized and dimensioned for covering said spout formed in said rim portion and being selectively displaceable therefrom by application of a transverse force to said thumb lever attached thereto by the beam member towards said lid, said lid assembly being an integral unitary single piece body.

5. A pitcher according to claim 4 further including first and second hinge portions on cooperative surfaces of said cap and said lid, said first hinge portion engaged with said second hinge portion providing rotation of said lid about a fixed point relative to said cap.

6. A pitcher according to claim 4 further including first and second hinge portions on cooperative surfaces of said cap and said lid, said first hinge portion engaged with said second hinge portion providing rotation of said lid about a fixed point relative to said cap; and a notch formed through a side of said cap generally opposite said hinge portions for receiving said beam member therein, said lid assembly being carried on said cap by attachment at said hinge portions and said beam member positioned in said notch.

7. A pitcher for holding and serving liquids, said pitcher comprising a cover assembly, a jar, and a ring member; said ring member being retained on said jar and said cover assembly attached to said ring member; said cover assembly including a rim portion defined by an aperture formed through said cover assembly, a spout integrally formed in a section of said rim portion, a cap covering said aperture and a lid assembly carried on said cap and movable relative to said cap and said spout; said lid assembly comprising a generally elongated beam member, a movable lid at one end of said elongated beam member and a thumb lever at the other end thereof, said lid being sized and dimensioned for covering said spout formed in said rim portion and being selectively displaceable therefrom by application of a transverse force to said thumb lever attached thereto by the beam member towards said lid; first and second hinge portions on cooperative surfaces of said cap and said lid, said first hinge portion engaged with said second hinge portion providing rotation of said lid about a fixed point relative to said cap; said lid and said beam member of said lid assembly are integrally formed as a unitary single piece body, a flexible joint between said lid and said beam member facilitating relative movement between said lid and said beam member, a force applied along said beam member towards said lid rotating said lid about said second hinge portion upwardly away from said spout with said lid and said beam member flexing at said flexible joint.

* * * * *

UNITED STATES PATENT AND TRADEMARK OFFICE

CERTIFICATE OF CORRECTION

PATENT NO. : 5,242,093

DATED : September 7, 1993

INVENTOR(S) : Robert Worell and William E. Midden

It is certified that error appears in the above-indentified patent and that said Letters Patent is hereby corrected as shown below:

On the title page:

[75] Inventors: "William E. Midden, Springfield, Minn " should read — William E. Midden, Springfield, Illinois —

Column 3, Line 49 " potion " should read — portion —

Signed and Sealed this

Twenty-sixth Day of April, 1994

Bruce Lehman

*Attest:*

BRUCE LEHMAN

*Attesting Officer*

*Commissioner of Patents and Trademarks*